US005152090A

United States Patent [19]

Jacobsen

[11] Patent Number: 5,152,090

[45] Date of Patent: Oct. 6, 1992

[54] PIVOTLESS WHEEL INDICIA DISPLAY DEVICE

[75] Inventor: Roger V. Jacobsen, Chicago, Ill.

[73] Assignee: Gary Jacobsen, Bensenville, Ill.

[21] Appl. No.: 574,830

[22] Filed: Aug. 29, 1990

Related U.S. Application Data

[63] Continuation-in-part of Ser. No. 352,768, May 16, 1989, Pat. No. 4,958,455.

[51] Int. Cl.[5] ..... G09F 11/04

[52] U.S. Cl. ..... 40/495

[58] Field of Search ..... 40/495, 299

[56] References Cited

U.S. PATENT DOCUMENTS

| | | | |
|---|---|---|---|
| 1,525,640 | 2/1925 | Bryant . | |
| 1,714,159 | 5/1929 | Crawford . | |
| 1,715,737 | 6/1929 | Bradley . | |
| 2,016,445 | 10/1935 | Massey . | |
| 2,386,082 | 10/1945 | Attridge | 40/495 X |
| 2,748,514 | 6/1956 | Sulger . | |
| 2,755,577 | 7/1956 | Greensfelder . | |
| 2,787,852 | 4/1957 | Youngren . | |
| 2,842,877 | 7/1958 | Stevens . | |
| 3,102,635 | 9/1963 | Werwin et al. . | |
| 3,103,080 | 9/1963 | Desmond . | |
| 3,209,476 | 10/1965 | Wachtel | 40/495 |
| 3,471,956 | 10/1969 | Walters | 40/495 |
| 3,820,263 | 6/1974 | Clark . | |
| 4,323,609 | 4/1982 | Bromberg . | |
| 4,373,281 | 2/1983 | Sebastian . | |
| 4,559,253 | 12/1985 | Thallinger | 40/495 X |

FOREIGN PATENT DOCUMENTS

| | | | |
|---|---|---|---|
| 626733 | 9/1927 | France | 40/495 |
| 2189216 | 10/1987 | United Kingdom | 40/299 |

*Primary Examiner*—Kenneth J. Dorner
*Assistant Examiner*—J. Bonifanti
*Attorney, Agent, or Firm*—Welsh & Katz, Ltd.

[57] ABSTRACT

An indicia display device is disclosed together with several processes for forming the device from a single piece of paper stock. The device includes a freely rotatable pivotless wheel element having indicia fixed thereon, a circular pocket for pivotlessly and rotatably containing the rotatable wheel element in the circular pocket, a viewing opening through which indicia on the wheel element are selectively visible, and a support guide along the perimeter of the circular pocket which abuts and guides the rotatable wheel element during rotation.

10 Claims, 5 Drawing Sheets

PIVOTLESS WHEEL INDICIA DISPLAY DEVICE

FIELD OF THE INVENTION

This is a continuation in part of application Ser. No. 07/352,768 filed May 16, 1989 now U.S. Pat. No. 4,958,455, in the name of Roger V. Jacobsen, covering "Pivotless Wheel Indicia Display Device".

This invention relates to a wheel indicia display device. More particularly, this invention relates to an indicia display device having a pivotless wheel element that is rotatably mounted in a circular pocket or cavity and that displays information and/or advertising indicia.

BACKGROUND OF THE INVENTION

A variety of involvement action devices or wheel-like elements that display information or advertising material are known. Involvement action devices include wheel-like elements which are manually rotated by the user and provide varying elements of information. However, it has been discovered that while such involvement action devices are popular, there are problems associated with their use, including frequent breakage and great expense of manufacture, and lengthy time for production.

There are presently available devices having manually rotatable internal wheel-like elements that display information or advertising indicia. For example, Bradley U.S. Pat. No. 1,715,737 and Sulger U.S. Pat. No. 2,748,514 illustrate devices having manually rotatable internal wheel-like elements. However, these devices each contemplate having a fixed pivot, in the nature of a rivet or the like, for rotatably mounting the rotatable element to the advertising device's carrier.

Other rotatable wheel elements include devices having a wheel which is secured by flanges that project around the perimeter of the wheel. However, these devices, as well as those of the prior art cited above are relatively costly to manufacture and break easily due to their particular type of construction, and have lengthy production times.

Accordingly, an object of the present invention is to provide an information or advertising display device having a wheel element that is pivotless, providing a unique method of manufacturing compared to current methods of manufacture.

Another object of the present invention is to provide an information or advertising display device including a pivotless wheel element that is manually rotatable and mounted in a circular pocket formed in the device, whereby the pocket forms an internal locking device for the wheel element, by means of precise die cutting, gluing, folding and trimming, all in one pass on a web press. A support guide is located along the perimeter of the circular pocket to help guide the wheel during rotation of the wheel.

Another object of the present invention is to provide a pivotless wheel element for an indicia display device that is die-cut from a single sheet of flat paper stock.

A further object of the present invention is to provide a pivotless wheel element that is relatively inexpensive to manufacture, and is capable of being produced in mass quantities within a short period of time compared to the standard method, which involves slower and costly production procedures.

SUMMARY OF THE INVENTION

The present invention, in the preferred embodiment, comprises a structure that accomplishes the foregoing objects by providing an involvement action indicia display device having a pivotless wheel element that is manually rotatably mounted in a circular pocket. The pivotless wheel element displays information and/or advertising indicia through cut-outs or/and die-cut windows in the structure.

The pivotless wheel element and its circular retention pocket are die-cut from one sheet of paper stock, from either a single web or double web method of a web printing press, wherein the die-cut paper stock is folded over, gummed, and cut to form the circular pocket which forms an internal locking device that holds the pivotless wheel element for manual rotation. It is precisely this inventive construction of the wheel element and circular locking or retention pocket, which involves the die-cutting, gumming, and folding of a single sheet of paper, that enables the wheel element to be constructed and rotatably mounted without a fixed pivot and to further be manufactured without great expense. This new manufacturing method eliminates the need for any assistance from human hand production methods. The pivotless wheel element is produced entirely in-line on the web printing press equipped with an in-line finishing system. During the manufacturing process, the wheel is delivered off the press without any further assistance by human hand operations, or additional off-line (post) machine operations.

In a further embodiment, the inventive device also accomplishes the aforementioned objects by providing a plurality of wheel elements, which are adjacent each other, that are pivotless and which are manually mounted in circular pockets within the same device. The pivotless wheel elements also display information and/or advertising indicia. These pivotless wheel elements and their circular retention pockets are similarly die-cut, gummed and folded from a single sheet of paper, as in the preferred embodiment.

In another embodiment, the inventive device also accomplishes the aforementioned objects by providing one or more wheel elements that are pivotless, which are manually mounted in circular pockets, and which display information and/or advertising indicia disposed on the pivotless wheel or wheels through apertures or windows which are located on the external surface of the circular retention pocket.

In yet another embodiment, the inventive device also accomplishes the aforementioned objects by providing one or more wheel elements that are pivotless, which are manually mounted in circular pockets and which include support guides or shoes located around the perimeter(s) of the circular pocket(s) and which serve to provide additional stability to the wheel. This embodiment includes apertures or windows which are symmetrically positioned on the external surface of the circular retention pocket and provide a means for rotating the pivotless wheel(s) within the circular pocket(s). This embodiment also may include additional apertures located on the external surface of the circular retention pocket for displaying information and for advertising indicia.

All of the aforementioned embodiments are adapted to be self-mailed without the use of a separate outer carrier envelope, if desired. The construction of the self-mailed pivotless wheel element and circular retention pocket is the same as the wheel elements of the other embodiments. Moreover, all of the embodiments may be removably attached to the inside seam of a saddle stitched or perfect bound magazine or book for mass distribution. The present invention can be used for any direct mail promotion, free standing inserts, magazine advertising inserts, sweepstake contests, or any field which uses mass produced printing for commercial advertising.

Thus, the present invention provides a pivotless wheel element that is rotatably mounted in a circular pocket and which further provides a vehicle for the display of information and/or advertising material. The inventive device is relatively inexpensive to manufacture, yet is more sturdy and durable than the previously described wheel-like elements of the prior art.

The above, as well as other objects and advantages of the invention, will become apparent from the following detailed description of the preferred embodiments, reference being made to the accompanying drawings.

DETAILED DESCRIPTION OF THE INVENTION

Figure 1:
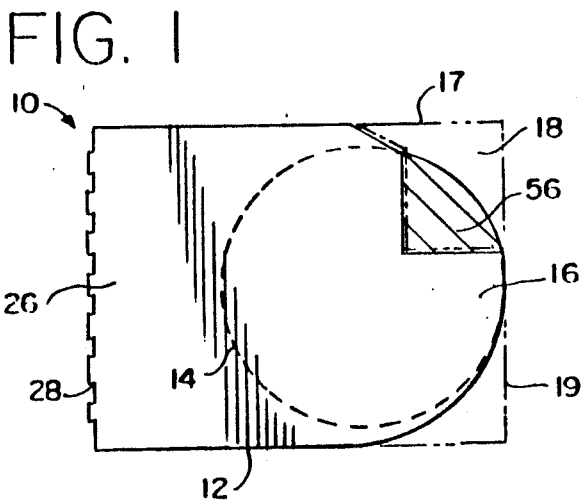
FIG. 1 is a plan view of the inventive indicia display device, illustrating the pivotless wheel element and circular mounting the pivotless wheel.

Referring first to FIG. 1, the invention provides a pivotless wheel indicia display device generally denoted by the numeral 10 having, in part a generally rectangular or square body 12, circular cavity or pocket 14, wheel element 16 and wheel opening 18. Generally, circular pocket 14 is formed by tacking down that portion of body 12 which surrounds circular pocket 14, as will be explained in more detail. Wheel element 16 is contained and rotates freely within circular pocket 14 in response to manual manipulation, held in place by the internal locking method formed by gumming, diecutting, and proper placement of the paper plies and gum.

Figure 2:
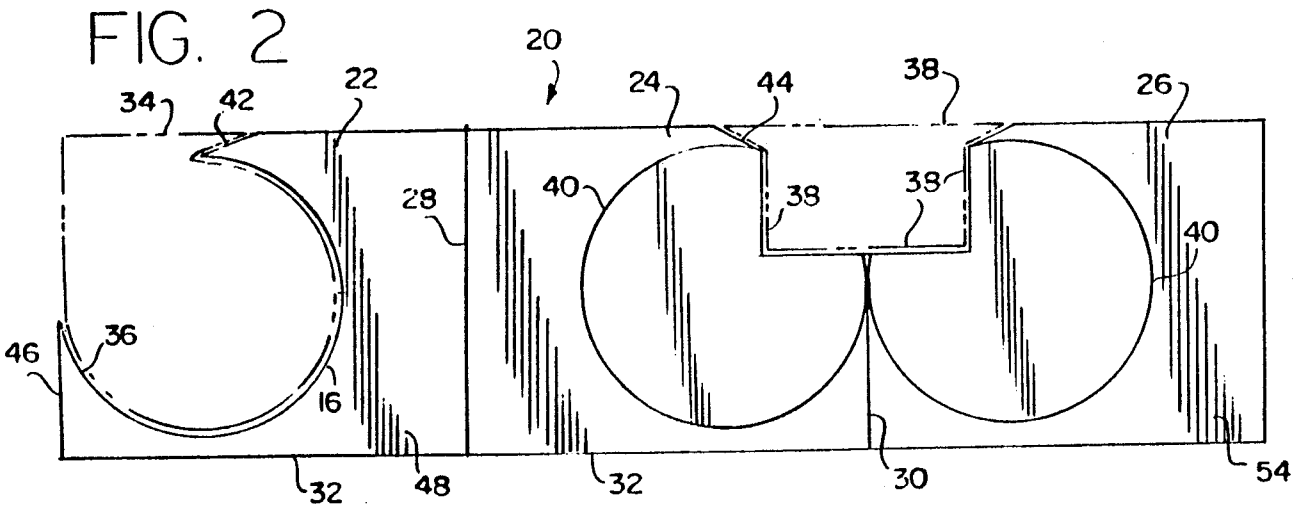
FIG. 2 is a plan view of the three ply panels which are die-cut and folded to form the inventive indicia display device of FIG. 1.

FIG. 1 shows the preferred embodiment of the inventive device 10 after assembly, which will be described in more detail. The entire device 10 of FIG. is constructed from a single sheet of paper stock as depicted in FIG. 2. In the preferred embodiment, the opening 18 is created by removing the portion of paper stock designated by the dotted lines 17 in FIG. 1. Also, if desired, the portion of paper stock indicated by the dotted lines 19 in FIG. 1 can be removed to provide a round or radiused look to the outer edge of the device 10 adjacent the wheel element 16. The removal of both parts designated by the lines 17 and 19 can be accomplished during the production of the device 10 by a rotary trimmer knife system which is usually the last process in an in-line finishing system associated with a web printing press.

FIG. 2 shows a single sheet of paper stock 20 which is diecut from a roll of web paper which is threaded through a conventional in-line web printing press with a rotary knife cutting system within. Paper 20 is generally rectangular in shape and comprises three panels or plies 22, 24, 26 having two score lines 28, 30 for folding plies 22, 24 and plies 24, 26, respectively. The solid line 32 and broken lines 34, 36, 38 outline the outer boundaries of plies 22, 24, 26 as they appear prior to being die-cut by the above mentioned cutting system.

Figure 3:
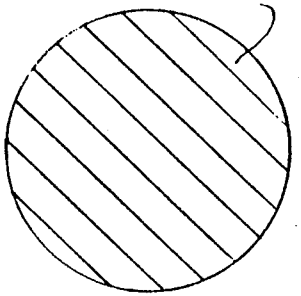
FIG. 3 is a plan view of the inventive pivotless wheel element that was die-cut from one of the panels of FIG. 2.

Ply 22 is die-cut so that the upper and outer corner, as depicted by broken line 34 of FIG. 2, is removed and discarded. Broken line 36 is die-cut from ply 22 in a circular configuration and becomes the wheel element 16, as shown in FIGS. 1 and 3. It can be clearly seen that the wheel element 16 has a circular outer periphery free of any outward radial projection.

Plies 24 and 26 are also die-cut along broken line 38 so that plies 24 and 26 are mirror images of each other. Score line 30 is removed, in part, subsequent to the die-cutting of broken line 38. The circle configuration 40 in plies 24 and 26 illustrated in FIG. 2 are not die-cut but merely represent the approximate location of wheel element 16 upon final assembly of device 10.

Figure 4:
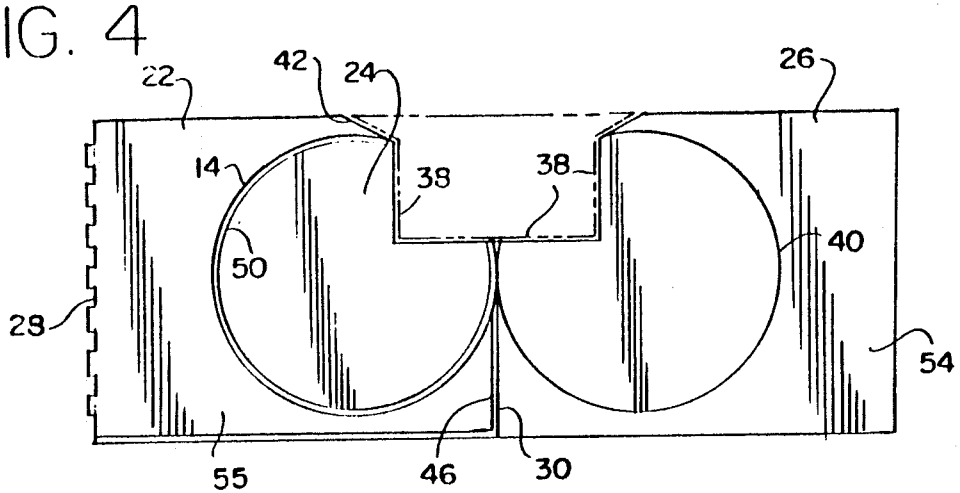
FIG. 4 is a plan view of the inventive circular pocket subsequent to folding one of the panels of FIG. 2.

After plies 22, 24, 26 have been die-cut as described, ply 22 is folded over and onto ply 24 along score line 28. Edge 42 and side 46 of ply 22 are aligned with edge 44 of ply 24 and score line 30, respectively. This alignment of ply 22 and ply 24 is depicted in FIG. 4. Glue or another adhesive substance is applied to that area of ply 22 designated by numeral 48, whereby ply 22 is securely and completely attached to ply 24.

FIG. 4 illustrates how ply 22 is positioned over ply 24 after ply 22 is folded over and onto ply 24 at score line 28. FIG. 4 further shows that after ply 22 is folded over onto ply 24, a circular portion of ply 24 is exposed. A section of ply 24 was previously die-cut along broken line 38, as explained in connection with FIG. 2.

The inner edge 50 of ply 22 outlines the opening created when ply 22 was die-cut and wheel element 16 was removed. Accordingly, inner edge 50 of ply 22 forms a cavity or circular pocket 14 in which wheel element 16 is rotatably mounted, to provide an internal locking device for wheel element 16 as will be described.

Ply 26 is also shown in FIG. 4, and broken line 38 shows where a portion of ply 26 has been die-cut. Circular configuration 40 shows the approximate location of wheel element 16 as it appears in device 10 of FIG. 1 subsequent to the folding over of ply 26 onto plies 22 and 24. Circular configuration 40 in FIG. 4 is not a die-cut.

After ply 22 has been glued or otherwise adhered to ply 24, ply 26 is similarly coated with glue or similar adhesive substance in the region 54 on ply 26 located outside circular configuration 40. Glue or adhesive is also applied to the region 55 of ply 22 outside of edge 50, as shown in FIG. 4. Wheel element 16, as seen in FIG. 3, is placed in circular pocket 14. Ply 26 is then folded over along score line 30 and onto ply 22. The glue or adhesive substance secures ply 22 to ply 26, and securely retains wheel element 16 internally in circular pocket 14. As ply 26 is the mirror image of ply 24, and because ply 22 is aligned with ply 24, ply 26 is symmetrical with plies 22 and 24, as shown in FIG. 1.

Referring again to FIG. 1, device 10 is shown with ply 26 covering plies 22 and 24. Score lines 28 and 30 define the side edges of device 10. The wheel opening 18 is the result of the removal of portions 34 and 38 of plies 22, 24 and 26. As ply 26 was die-cut along broken lines 38, wheel element 16 is exposed at area 56. Moreover, as no glue or sticky substance was applied to wheel element 16, circular pocket 14, or that area of circular configuration 40 of ply 26 covering wheel element 16, wheel element 16 is pivotlessly and rotatably mounted within circular pocket 14.

Rotation of wheel element 16 of device 10 is performed manually. The user of device 10 simply grasps the exposed portion 56 of wheel element 16 and manually moves the wheel in either direction. Wheel element 16 freely rotates Within circular pocket 14. The wheel element 16 has been pre-printed with advertising or other information prior to its insertion into circular pocket 14, which appears selectively in exposed wheel opening 18 (FIG. 1).

Figure 5:
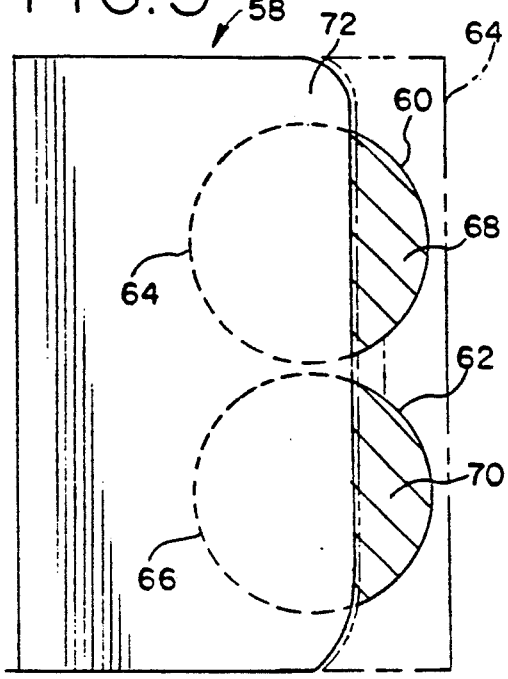
FIG. 5 is a plan view of another embodiment of the inventive device having a plurality of pivotless wheel elements and circular pockets, showing a finished, final product.

FIG. 5 illustrates another embodiment of the inventive display device 10. The device 58 of FIG. 5 includes two wheel elements 60, 62 that are rotatably mounted in circular pockets 64, 66, respectively. Exposed area 68, 70 of wheel elements 60, 62, respectively, extend outwardly from edge 72 of device 58. Lines 69 in FIG. 5 represent portions of each ply which have been removed, similar to lines 34, 38 in FIG. 2. Wheel elements 68, 70 freely rotate within circular pockets 64, 66.

Device 58 is generally designed and constructed in the same manner as device 10 of FIG. 1. Device 58 initially consisted of three plies that were die-cut in certain areas and then folded over onto each other along score lines. Die-cut wheel elements 68, 70 are positioned within circular pockets 64, 66 and then encased within the folded plies, as was described in the previously described embodiment. Each wheel element 68, 70 contains pre-printed information or advertising, similar to device 10 of FIG. 1. The wheels 68, 70 are adapted to be manually rotated in pockets 64, 66.

Figure 6:
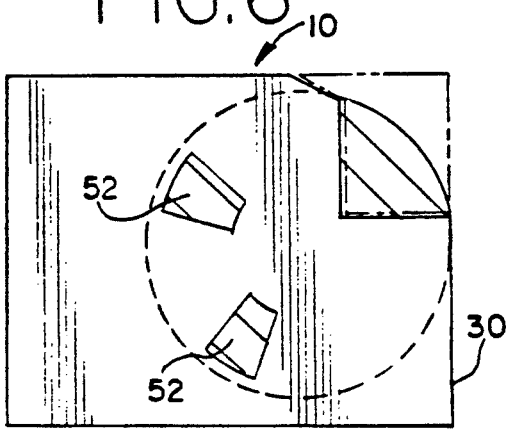
FIG. 6 is a plan view of another embodiment of the inventive device of FIG. 1, having a plurality of viewing apertures preferably formed by using a die-cutting unit within the web press in-line finishing system.

FIG. 6 shows another embodiment of the inventive display device 10. This embodiment is exactly the same as the embodiment of FIG. 1, except that the apparatus of FIG. 6 includes additional viewing apertures 52 which are die cut into ply 26 before ply 26 is folded onto ply 24 along score line 30. Apertures 52 simultaneously expose additional areas of wheel element 16. Several apertures 52 may be die-cut from ply 26. Apertures 52 serve to expose more of wheel element 16 and therefore, allow for more information or advertising to be displayed. Apertures 52 may also be included in the above described embodiment depicted in FIG. 5.

Figure 7:
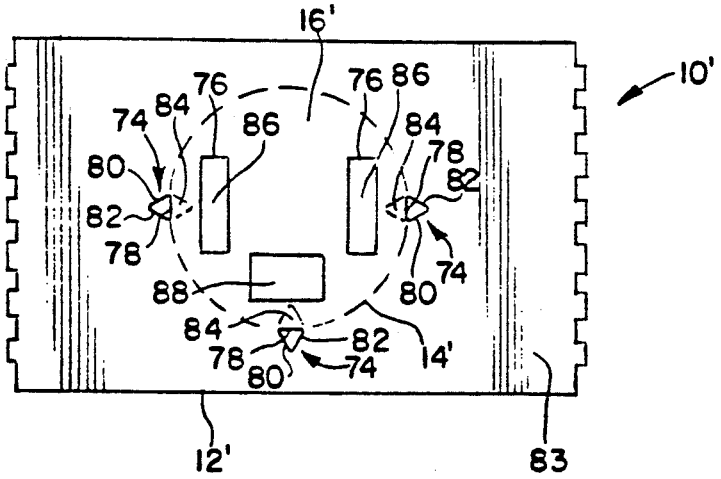
FIG. 7 is a view of another embodiment of the inventive indicia display device, illustrating a plurality of support guides which provide the pivotless wheel element with additional support.

FIG. 7 shows another embodiment of a pivotless wheel indicia display device generally denoted by the numeral 10' having, in part, a generally rectangular or square body 12', circular cavity or pocket 14', wheel element 16', support guides or shoes 74 and rotation apertures 76. Generally, circular pocket 14' is formed by tacking down that portion of body 12' which surrounds circular pocket 14', as previously described in the preferred embodiment. Wheel element 16' is contained within circular pocket 14' by the internal locking method formed by gumming, which was previously described in relation to the preferred embodiment, and by a plurality of support guides 74 which are placed in various locations along the perimeter of circular pocket 14'. Wheel element 16' rotates freely within circular pocket 14' in response to manual manipulation which is accomplished through rotation apertures 76.

Figure 8:
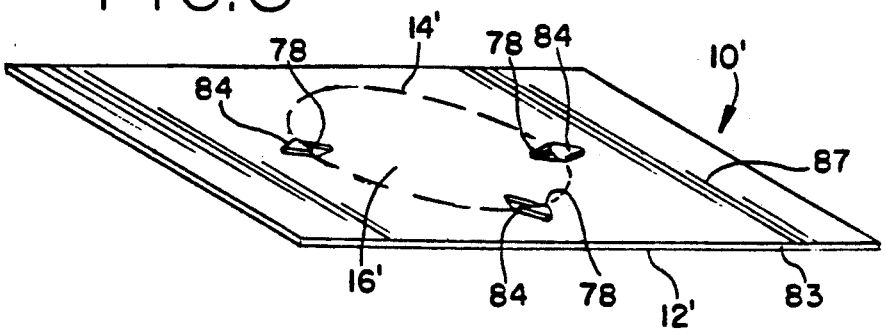
FIG. 8 is a perspective view of the underside of the embodiment of FIG. 7.

Referring to FIGS. 7 and 8, support guides 74 are generally triangular in shape but may also have other suitable shapes, with a base 78 of the triangle abutting the perimeter of circular cavity 14'. The support guides 74 are formed from the 12' itself by cutting along sides 80, 82 through a front side 83 and then folding same downwardly from the front side 83 along base 78 and bending inwardly so that a tab 84 is formed on the backside 86 of body 12' (see FIG. 8). Thus, as wheel 16' is rotated within circular pocket 14', the perimeter of wheel 16' abuts base 78 of guides 74 and serves to support wheel 16' as it rotates.

Wheel 16' of FIG. 7 further includes rotation apertures 76 which are symmetrically positioned on that portion of body 12' which overlies circular cavity 14'. Thus, wheel 16' is exposed in areas 87 through apertures 76. Accordingly, wheel 16' is rotated by manually manipulating the exposed areas 87 of wheel 16'. Exposed areas 87 are not only used for manual rotation of wheel 16' but also may be preprinted with advertising or other information which may be viewed through rotation apertures 76. FIG. 7 also shows an opening 88 which may be used for similar viewing purposes.

The aforementioned embodiments may be manufactured by any one of the following continuous in-line processes. The first process has been generally described in reference to the first embodiment.

Figure 9:
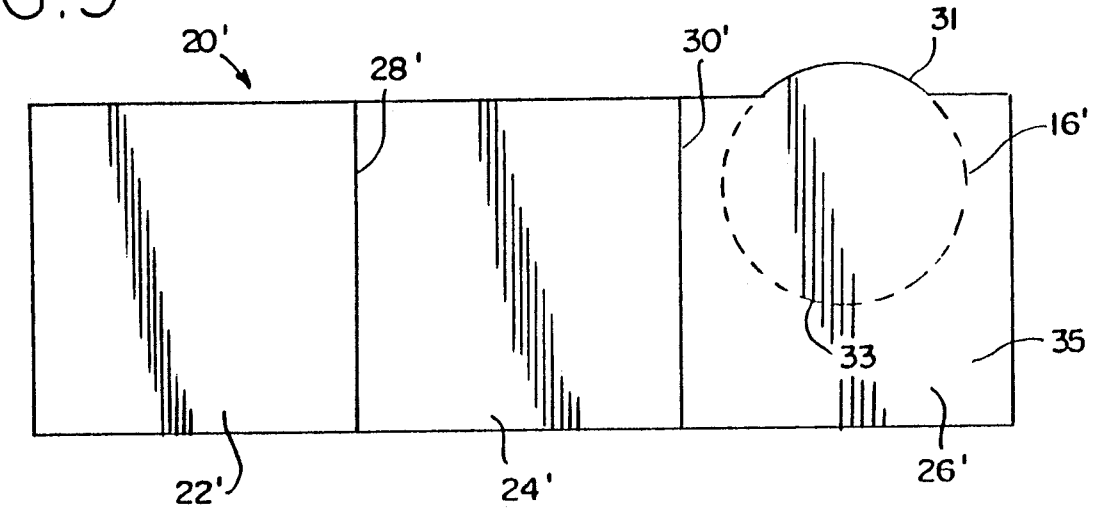
FIG. 9 is a plan view of the three ply panels which are die-cut, gummed and folded during a first or plow method of manufacture of the inventive indicia display device of FIGS. 1 and 7.

Referring to FIG. 9, the first process, commonly known as the plow method, involves taking one continuous sheet of paper stock 20' and folding same into three panels or plies 22', 24', 26' along score lines 28' and 30'. Panel 26' includes an outwardly curved portion 31 which is a portion of wheel element 16', as illustrated by broken line 33, and which will be described in greater detail later.

Prior to the folding of panels 22', 24', 26', information is printed, as desired, onto paper stock 20' Also, prior to the above folding step, wheel element 16' is die-cut from paper stock 20' along broken line 33. Wheel projects slightly above panel 26'. Moreover, the viewing apertures described in the aforementioned embodiments are die-cut at this time.

Figure 11:
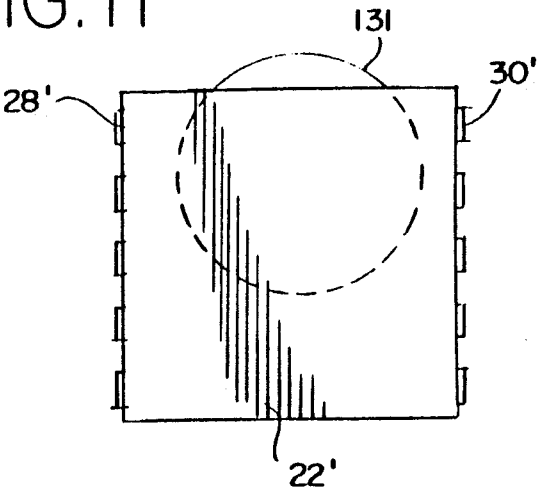
FIG. 11 is a plan view of the inventive device subsequent to folding another of the panels of FIG. 9.
Figure 10:
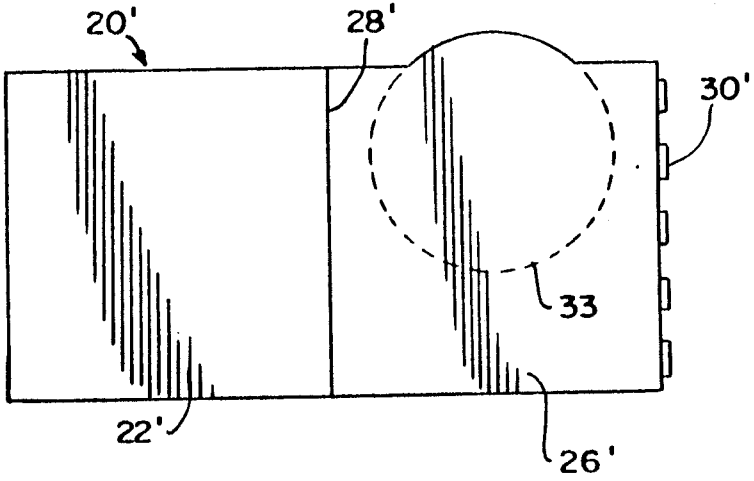
FIG. 10 is a plan view of the inventive device subsequent to folding of one of the panels of FIG. 9.

Subsequent to die-cutting wheel element 16', an adhesive or glue material is applied to that area of panel 26' designated by numeral 35. Panel 26' is then folded along score line 30' over and onto panel 24'. Again, an adhesive or glue material is applied to the backside of panel 26', as shown in FIG. 10. Panel 22' is subsequently folded along score line 28' over and onto panel 26', as illustrated in FIG. 11.

Figure 12:
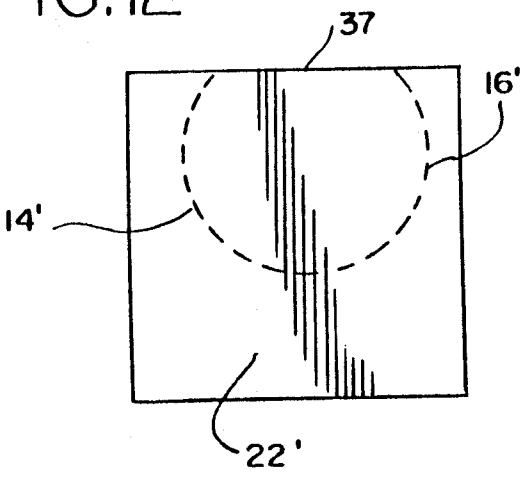
FIG. 12 is a plan view of the inventive device subsequent to the chop-cutting of the wheel element of FIG. 9.

Finally, curved portion 31 of wheel element 16' is removed by a chop cut so that wheel element 16' includes a blunt edge 37 which is aligned with the edge of panel 22' (see FIG. 12). Wheel element 16' is then free to rotate within a cavity or circular pocket 14, which was formed when ply 26' was die-cut to form wheel element 16'.

Figure 13:
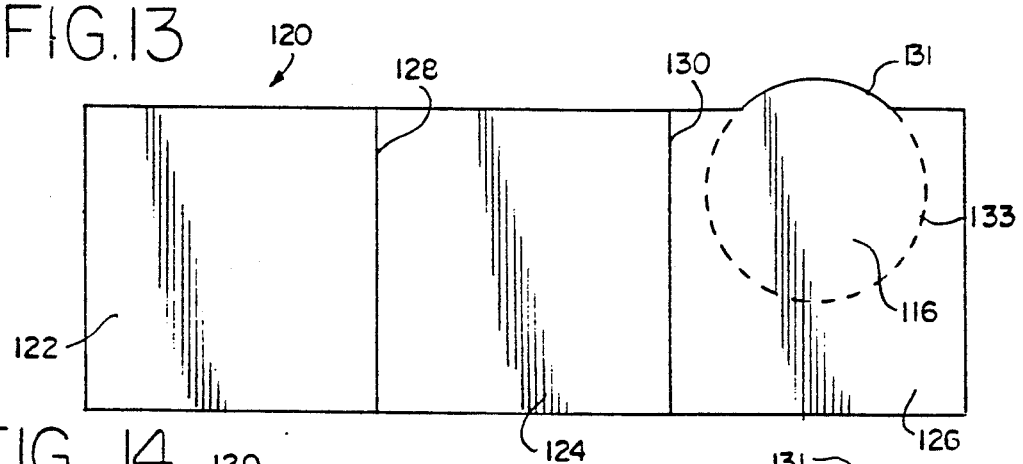
FIG. 13 is a plan view of the three ply panels which are die-cut, slit, gummed and folded during a second or ribbon plus plow combination method of manufacture of the inventive indicia device of FIGS. 1 and 7.

The second process for manufacturing the pivotless wheel elements described in the aforementioned embodiments, and commonly known as the ribbon plus plow method, involves taking one continuous sheet of paper stock 120 and dividing same into three panels or plies 122, 124, 126 along score lines 128 and 130, as illustrated in FIG. 13. Panel 126 includes an outwardly curved portion 131 which is a portion of wheel element 116, as illustrated by broken line 133.

Figure 14:
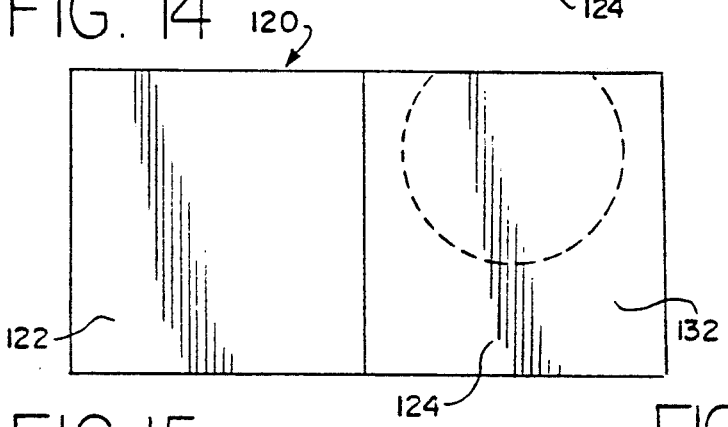
FIG. 14 is a plan view of the inventive device subsequent to the slitting and separation of one of the panels of FIG. 13.
Figure 14:
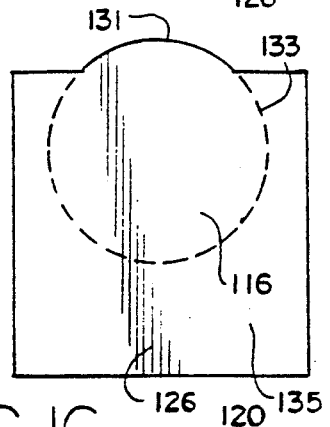

Wheel element 116 is then die-cut from panel 126 along broken line 133. Wheel element 116 is not die-cut along curved portion 131 and accordingly, remains attached to panel 126 at that point. As shown in FIG. 14, after die-cutting wheel element 116, panel 126 is slit along score line 130 and separated from panels 122 and 124.

Figure 15:
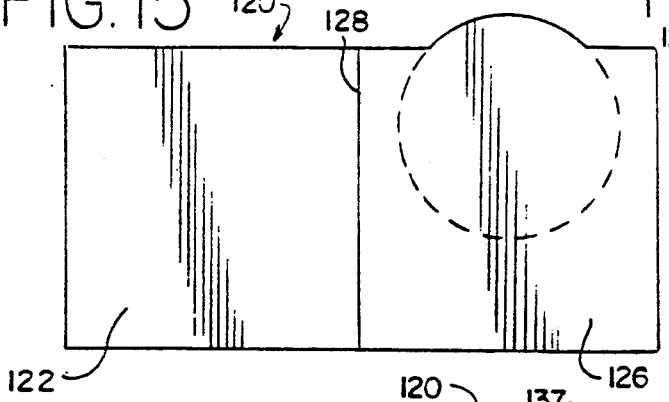
FIG. 15 is a plan view of the inventive device subsequent to the gluing of the separated panel onto another of the panels of FIG. 13.
Figure 16:
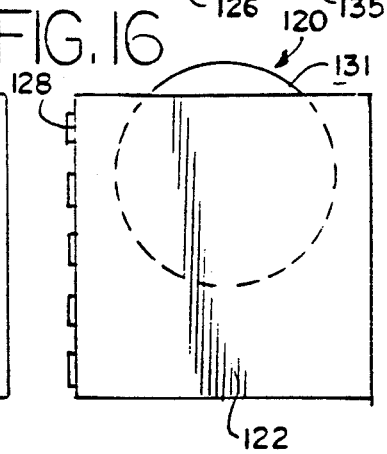
FIG. 16 is a plan view of the inventive device subsequent to folding one of the panels of FIG. 13.

Glue or another adhesive material is applied to that area of panels 124 and 126 designated by numerals 132 and 135, respectively. After the glue application, panel 126 is placed over and aligned with panel 124, as shown in FIG. 15. Panel 122 is then folded over and onto panel 126 along score line 128, as illustrated in FIG. 16.

Figure 17:
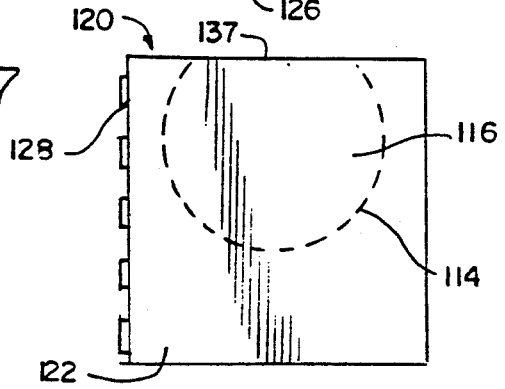
FIG. 17 is a plan view of the inventive device subsequent to the chop-cutting of the wheel element of FIG. 13.

Finally, curved portion 131 (see FIG. 16) is removed by a chop cut so that wheel element 116 includes a blunt edge 137 (see FIG. 17) which is aligned with the edge of panel 122. Wheel element 116 is then capable of freely rotating within cavity 114.

An alternate method of ribbon plus plow construction comprises folding panels 122 and 124 along score line 128 after panel 126 is slit along score line 130, whereby panel 122 overlies panel 124. Glue is applied to both sides of panel 126 in the areas designated by the numeral 135 in FIG. 14, and panel 126 is moved into position between folded over panels 122 and 124. Pressure is applied to the outer panels, whereby the glue adheres panels 122, 124 and 126 together in the areas where glue is disposed. Curved portion 131 of wheel element 116 is then removed as described above, allowing wheel element 116 to freely rotate within cavity 114.

Figure 18:
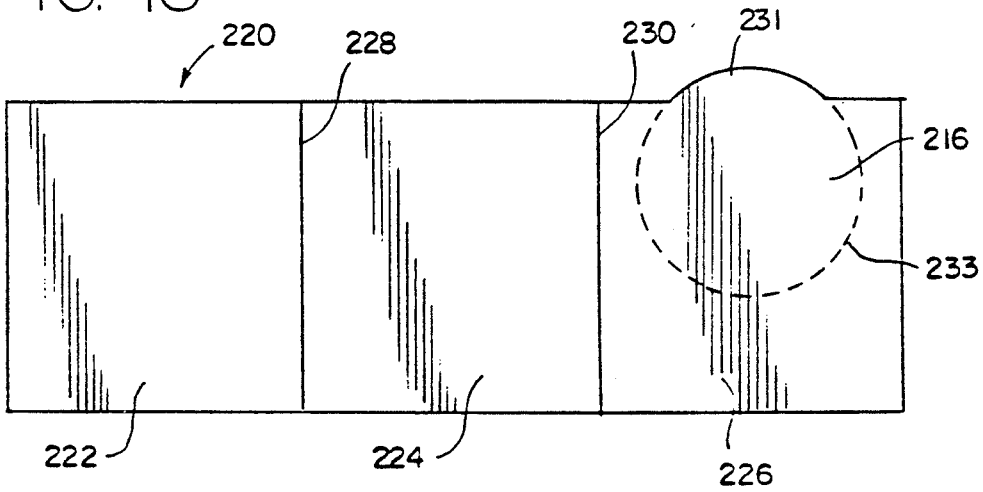
FIG. 18 is a plan view of the three ply panels which are die-cut, slit and gummed during a third or pure ribboning method of manufacture of the inventive indicia display device of FIGS. 1 and 7.

The third process for manufacturing the pivotless wheel elements in the previous embodiments, known as the pure ribboning method, involves taking one continuous sheet of paper stock 220 and dividing same into three substantially equal sized panels 222, 224, 226 along score lines 228, and 230, as shown in FIG. 18.

Wheel element 216 is then die-cut from panel 226 along broken line 233. Wheel element 216 is not die-cut along curved portion 231 and therefore, remains attached to panel 226 at that point.

Figure 19:
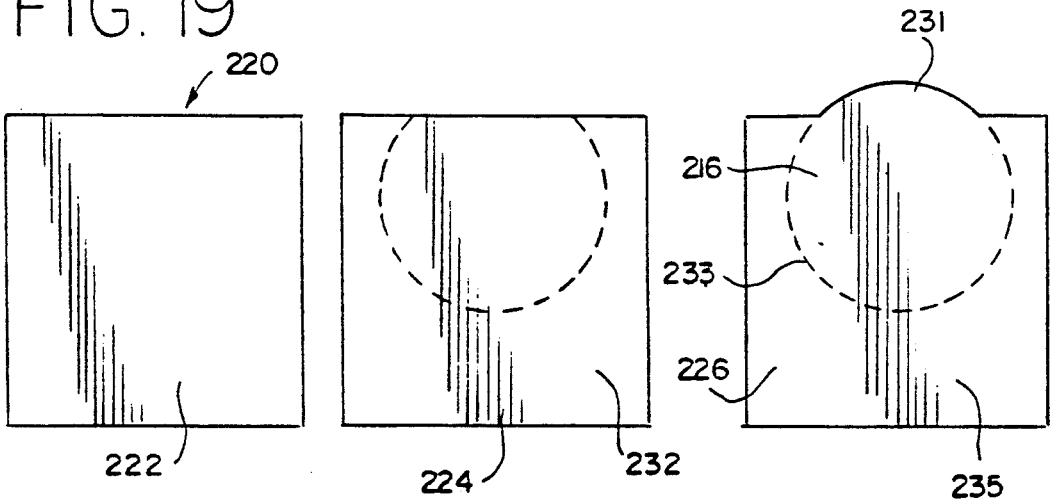
FIG. 19 is a plan view of the inventive device subsequent to the slitting and separation of the panels of FIG. 18.

Next, panels 222, 224, and 226 are separated by slitting same along score lines 228 and 230, as shown in FIG. 19.

Figure 20:
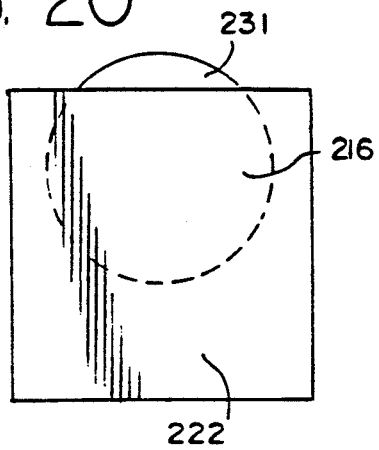
FIG. 20 is a plan view of the inventive device subsequent to the nesting of the panels of FIG. 18.

Glue or another adhesive material is applied to that area of panels 224 and 226 designated by numerals 232 and 235, respectively (see FIG. 19). After the glue application, the panels are nested by placing panel 226 over and onto panel 224 and likewise placing panel 222 over and onto panel 224. The resulting nested configuration is shown in FIG. 20.

Figure 21:
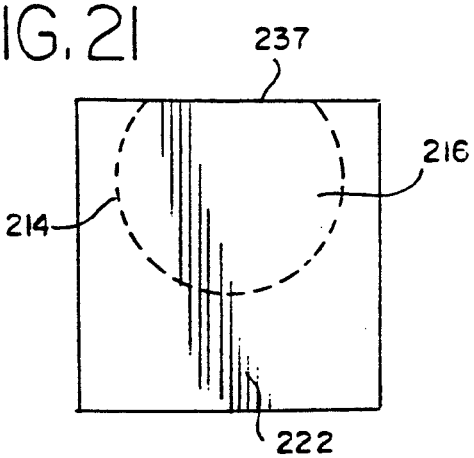
FIG. 21 is a plan view of the inventive device subsequent to the chop-cutting of the wheel element of FIG. 18.

Finally, curved portion 231 (see FIG. 20) is removed by a chop cut so that wheel element 216 includes a blunt edge 237 (see FIG. 21) which is aligned with the edge of panel 222. Wheel element 216 is then capable of freely rotating within cavity 214.

In all of the above-described processes, the wheel element may be positioned on the panel in any one of numerous locations, as long as a curved portion of the wheel element projects outwardly from an edge of the panel. Thus, the wheel element may be positioned on the top of the panel, as illustrated in the drawings, or on the side and/or bottom of the panel.

The above-described processes are preferably manufactured entirely in one step and on a single press system. An inventive pivotless wheel is produced on the aforementioned single web printing press with a suitable in-line finishing system. The daily production rate during a 24 hour period is from 960,000 wheels (in a 2-out press layout) to 3,840,000 wheels (in an 8-out press layout). The above-cited figures are based on running 20,000 press impressions per hour on a press sheet having the approximate dimensions of $22\frac{3}{4}$ or $23\frac{1}{2} \times 36$ or 38 inches. These are approximate figures due to other variable factors that affect press speed.

The materials from which devices 10 and 58 of the different embodiments are constructed include sturdy, light weight, medium weight or heavy weight paper, subject to limitations of equipment, based on the size of the wheel elements, for example. The devices 10 and 58 are adapted to be able to be die-cut on a conventional die-cutting unit within the web press and its in line finishing system. Wheel elements 16, 60 and 62 are preprinted with conventional web press offset lithographic printing means. Devices 10 and 58 are held together and secure wheel elements 16, 60, 62 in circular pockets 14, 64, 66 by the use of any adhesive substance, such as glue, cement, liquid adhesives or the like, which are preferably applied by a gum unit within the web press in-line finishing system.

Moreover, devices 10, 10', and 58 have not been described in terms of approximate measurements of the various components, as it should be understood that the size of devices 10, 10', and 58 may vary according to need. Thus, there may be a plurality of sizes of devices 10, 10', and 58. The sizes can vary, but are limited to the manufacturing equipment's capabilities.

Therefore, it should be recognized that, while the invention has been described in relation to a preferred embodiment thereof those skilled in the art, may develop a wide variation of structural details without departing from the principles of the invention. Therefore, the appended claims are to be construed to cover all equivalents falling within the true scope and spirit of the invention.

The invention claimed is:

1. An indicia display device comprising:

a body portion having a front side and a back side;

a circular pocket disposed within said body portion for pivotlessly containing a rotatable wheel for rotation in said pocket;

a freely rotatable pivotless wheel within said circular pocket having indicia fixed on a front circular face and having a circular outer periphery free of any outward projection;

at least one viewing aperture formed in said front side of said body portion through which selected indicia of said indicia on said freely rotatable wheel appear as said wheel is rotated;

at least one tab integrally formed from said body portion, said tab having at least one side and a base, said tab being folded over along said base, from said front side onto said back side of said body portion, said tab providing support and acting as a guide for said freely rotatable pivotless wheel; and said at least one tab being located along the circular perimeter of said circular pocket, said at least one tab abutting and guiding said freely rotatable pivotless wheel during rotation of said wheel.

2. The indicia display device of claim 1 wherein said circular pocket includes a circular edge, and said freely rotatable pivotless wheel includes an outer edge of said circular outer periphery which engages said support guide and said circular edge of said pocket.

3. The indicia display device of claim 1 wherein said at least one viewing aperture extends from an outer portion of said circular pocket towards an edge of said front side, said viewing aperture exposing a portion of said freely rotatable pivotless wheel.

4. The indicia display device of claim 3 wherein said indicia on said freely rotatable pivotless wheel is viewed through said viewing aperture.

5. The indicia display device of claim 1 wherein said front side includes a plurality of viewing apertures through which selected indicia appear.

6. The indicia display device of claim 1 wherein a plurality of freely rotatable pivotless wheels are contained in a plurality of circular pockets, each of said pockets rotatably and pivotlessly containing one of said freely rotatable pivotless wheels.

7. The indicia display device of claim 6 including a plurality of viewing apertures in said front side for viewing indicia on a front circular face of each freely rotatable pivotless wheel.

8. The indicia display device of claim 6 wherein at least one tab is located along the perimeter of each said circular pockets, said tab abutting and guiding each said freely rotatable pivotless wheel during rotation.

9. The indicia display device of claim 8 wherein said at least one tab is substantially triangular.

10. The indicia display device of claim 1 wherein said at least one tab is substantially triangular.

* * * * *